US012575597B2

(12) United States Patent
Jung et al.

(10) Patent No.: US 12,575,597 B2
(45) Date of Patent: Mar. 17, 2026

(54) NICOTINE SHEET AND AEROSOL-GENERATING ARTICLE INCLUDING THE SAME

(71) Applicant: KT&G CORPORATION, Daejeon (KR)

(72) Inventors: Kyung Bin Jung, Daejeon (KR); Ick Joong Kim, Daejeon (KR); Geon Chang Lee, Daejeon (KR); Eun Mi Jeoung, Daejeon (KR); Min Hee Hwang, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 354 days.

(21) Appl. No.: 18/036,489

(22) PCT Filed: Apr. 21, 2022

(86) PCT No.: PCT/KR2022/005749
§ 371 (c)(1),
(2) Date: May 11, 2023

(87) PCT Pub. No.: WO2022/240001
PCT Pub. Date: Nov. 17, 2022

(65) Prior Publication Data

US 2024/0008525 A1 Jan. 11, 2024

(30) Foreign Application Priority Data

May 12, 2021 (KR) ..... 10-2021-0061096

(51) Int. Cl.
*A24D 1/00* (2020.01)
*A24B 15/12* (2006.01)
(Continued)

(52) U.S. Cl.
CPC ..... *A24D 1/002* (2013.01); *A24B 15/12* (2013.01); *A24B 15/167* (2016.11);
(Continued)

(58) Field of Classification Search
None
See application file for complete search history.

(56) References Cited

U.S. PATENT DOCUMENTS

2008/0260807 A1 10/2008 Sharp et al.
2019/0328031 A1 10/2019 Deforel et al.
(Continued)

FOREIGN PATENT DOCUMENTS

CN 110035669 A 7/2019
EP 4 140 328 A1 3/2023
(Continued)

OTHER PUBLICATIONS

International Search Report of PCT/KR2022/005749 dated Aug. 1, 2022 [PCT/ISA/210].
(Continued)

*Primary Examiner* — Dennis R Cordray
(74) *Attorney, Agent, or Firm* — Sughrue Mion, PLLC

(57) ABSTRACT

A nicotine sheet and an aerosol-generating article including the same are provided. The nicotine sheet according to some embodiments of the present disclosure may include a nicotine material which includes a nicotine component and a cellulose-based material which forms a sheet. The nicotine sheet may, when heated, slowly release the nicotine component fixed therein and thus can improve persistence of a tobacco smoke taste of an aerosol-generating article.

14 Claims, 7 Drawing Sheets

(51) Int. Cl.

| | |
|---|---|
| ***A24B 15/167*** | (2020.01) |
| ***A24B 15/38*** | (2006.01) |
| ***A24B 15/40*** | (2006.01) |
| ***A24D 1/02*** | (2006.01) |
| ***A24D 1/18*** | (2006.01) |
| ***A24D 1/20*** | (2020.01) |

(52) U.S. Cl.
CPC ..... *A24B 15/385* (2013.01); *A24B 15/403* (2013.01); *A24D 1/02* (2013.01); *A24D 1/18* (2013.01); *A24D 1/20* (2020.01)

(56) References Cited

U.S. PATENT DOCUMENTS

| | | | | |
|---|---|---|---|---|
| 2020/0054064 | A1* | 2/2020 | Ajithkumar ..... | A24B 15/165 |
| 2020/0100538 | A1 | 4/2020 | Deforel et al. | |
| 2020/0383372 | A1 | 12/2020 | Stahl et al. | |
| 2021/0329964 | A1* | 10/2021 | Deforel ..... | A24B 15/285 |

FOREIGN PATENT DOCUMENTS

| | | | |
|---|---|---|---|
| JP | 2020-513740 | A | 5/2020 |
| KR | 10-2019-0098162 | A | 8/2019 |
| WO | 2006/114604 | A2 | 11/2006 |
| WO | 2018/122060 | A1 | 7/2018 |
| WO | 2018/122095 | A1 | 7/2018 |
| WO | 2020/002583 | A1 | 1/2020 |
| WO | 2020/025727 | A1 | 2/2020 |

OTHER PUBLICATIONS

Extended European Search Report dated Mar. 15, 2024 in Application No. 22807649.3.

* cited by examiner

NICOTINE SHEET AND AEROSOL-GENERATING ARTICLE INCLUDING THE SAME

CROSS REFERENCE TO RELATED APPLICATIONS

This application is a National Stage of International Application No. PCT/KR2022/005749, filed Apr. 21, 2022, claiming priority to Korean Patent Application No. 10-2021-0061096, filed May 12, 2021.

TECHNICAL FIELD

The present disclosure relates to a nicotine sheet and an aerosol-generating article including the same, and more particularly, to a nicotine sheet capable of improving persistence of a tobacco smoke taste of an aerosol-generating article, an aerosol-generating article including the same, and a method of producing the nicotine sheet and the aerosol-generating article.

BACKGROUND ART

In recent years, demand for alternative articles that overcome the disadvantages of traditional cigarettes has increased. For example, demand for heating-type cigarettes that generate an aerosol when electrically heated by a dedicated device has increased, and accordingly, intensive research has been carried out on heating-type cigarettes.

A problem of heating-type cigarettes that has recently become an issue is the persistence of a tobacco smoke taste. Most heating-type cigarettes express a sufficient tobacco smoke taste in early puffs, but the tobacco smoke taste tends to sharply decrease in later puffs. Accordingly, there is demand for ways to compensate the tobacco smoke taste in mid and late puffs.

DISCLOSURE

Technical Problem

Some embodiments of the present disclosure are directed to providing a nicotine sheet capable of improving persistence of a tobacco smoke taste and a method of producing the same.

Some embodiments of the present disclosure are also directed to providing an aerosol-generating article with improved persistence of a tobacco smoke taste and a method of producing the same.

Objectives of the present disclosure are not limited to the above-mentioned objectives, and other unmentioned objectives should be clearly understood by those of ordinary skill in the art to which the present disclosure pertains from the description below.

Technical Solution

Some embodiments of the present disclosure provide a nicotine sheet including a nicotine material which includes a nicotine component and a cellulose-based material which forms a sheet.

In some embodiments, the nicotine material may include nicotine salt formed by an organic acid.

In some embodiments, the organic acid may include at least one acid selected from a benzoic acid, a pyruvic acid, a lactic acid, an acetic acid, and a citric acid.

In some embodiments, the nicotine component may be 2 parts by weight or more with respect to a total of 100 parts by weight of the nicotine sheet.

In some embodiments, the cellulose-based material may include at least one material selected from hydroxypropyl methylcellulose (HPMC), methyl cellulose (MC), ethyl cellulose (EC), carboxymethyl cellulose (CMC), and agar.

In some embodiments, the nicotine sheet may further include an aerosol-forming agent.

In some embodiments, the aerosol-forming agent may be in a range of 5 to 20 parts by weight with respect to a total of 100 parts by weight of the nicotine sheet.

Some embodiments of the present disclosure provide an aerosol-generating article including a filter part, an aerosol-forming substrate part, and a wrapper wrapped around at least a portion of the filter part and the aerosol-forming substrate part. Here, a nicotine sheet may be applied to the aerosol-forming substrate part or the wrapper, and the nicotine sheet may include a cellulose-based material and a nicotine material.

In some embodiments, the nicotine sheet may be pleated or folded.

In some embodiments, a plurality of holes may be formed in the nicotine sheet.

In some embodiments, the nicotine sheet may be included in a cut form in the aerosol-forming substrate part.

In some embodiments, the nicotine sheet may be included in a rolled from in the aerosol-forming substrate part.

In some embodiments, the nicotine sheet may be disposed on an inner side of the wrapper.

Advantageous Effects

According to some embodiments of the present disclosure, a sheet containing a nicotine component (e.g., nicotine, nicotine salt) may be provided. The provided nicotine sheet may, when heated, slowly release the nicotine component fixed therein and thus can improve persistence of a tobacco smoke taste of an aerosol-generating article.

Also, a nicotine sheet may be produced by mixing a nicotine material (e.g., nicotine, nicotine salt), a cellulose-based sheet-forming agent, and an aerosol-forming agent, and the nicotine sheet produced in this way may have an excellent holding amount, retention, and transfer amount of nicotine. Specifically, an excellent holding amount and retention of nicotine can be ensured by the cellulose-based material covering and fixing the nicotine material well, and an excellent transfer amount of nicotine can be ensured by an aerosol, which is formed by the aerosol-forming agent, promoting transfer of the nicotine material.

In addition, by the nicotine sheet being applied in various forms to the aerosol-generating article, an aerosol-generating article with improved persistence of a tobacco smoke taste can be easily manufactured.

The advantageous effects according to the technical spirit of the present disclosure are not limited to those mentioned above, and other unmentioned advantageous effects should be clearly understood by those of ordinary skill in the art from the description below.

MODES OF THE INVENTION

Figure 1:
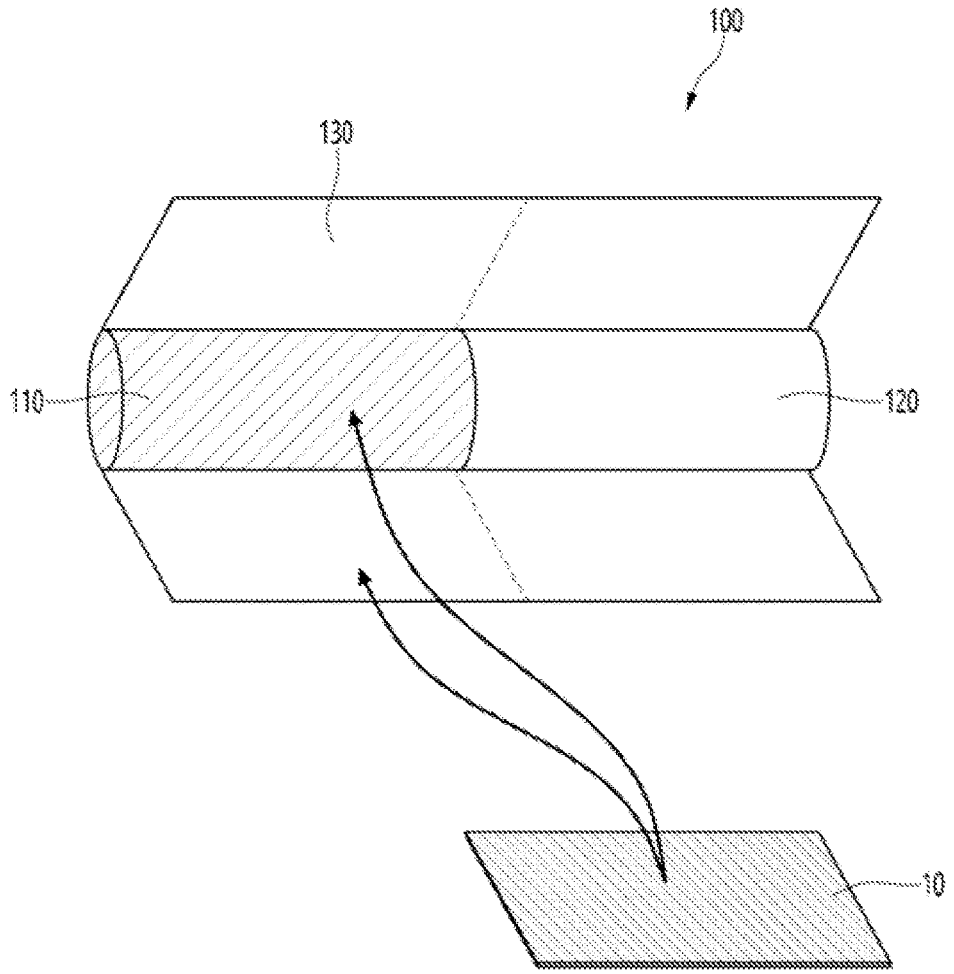
FIG. 1 is an exemplary view schematically illustrating an aerosol-generating article according to some embodiments of the present disclosure.

Hereinafter, exemplary embodiments of the present disclosure will be described in detail with reference to the accompanying drawings. Advantages and features of the present disclosure and methods of achieving the same should become clear from embodiments described in detail below with reference to the accompanying drawings. However, the technical spirit of the present disclosure is not limited to the following embodiments and may be implemented in various different forms. The following embodiments only make the technical spirit of the present disclosure complete and are provided to completely inform those of ordinary skill in the art to which the present disclosure pertains of the scope of the disclosure. The technical spirit of the present disclosure is defined only by the scope of the claims.

In assigning reference numerals to components of each drawing, it should be noted that the same reference numerals are assigned to the same components where possible even when the components are illustrated in different drawings. Also, in describing the present disclosure, when detailed description of a known related configuration or function is deemed as having the possibility of obscuring the gist of the present disclosure, the detailed description thereof will be omitted.

Unless otherwise defined, all terms including technical or scientific terms used in this specification have the same meaning as commonly understood by those of ordinary skill in the art to which the present disclosure pertains. Terms defined in commonly used dictionaries should not be construed in an idealized or overly formal sense unless expressly so defined herein. Terms used in this specification are for describing the embodiments and are not intended to limit the present disclosure. In this specification, a singular expression includes a plural expression unless the context clearly indicates otherwise.

Also, in describing components of the present disclosure, terms such as first, second, A, B, (a), and (b) may be used. Such terms are only used for distinguishing one component from another component, and the essence, order, sequence, or the like of the corresponding component is not limited by the terms. In a case in which a certain component is described as being "connected," "coupled," or "linked" to another component, it should be understood that, although the component may be directly connected or linked to the other component, still another component may also be "connected," "coupled," or "linked" between the two components.

The terms "comprises" and/or "comprising" used herein do not preclude the possibility of presence or addition of one or more components, steps, operations, and/or devices other than those mentioned.

Prior to the description of various embodiments of the present disclosure, some terms used in the following embodiments will be clarified.

In the following embodiments, "aerosol-forming substrate" may refer to a material that is able to form an aerosol. The aerosol may include a volatile compound. The aerosol-forming substrate may be a solid or liquid.

For example, solid aerosol-forming substrates may include solid materials based on tobacco raw materials such as reconstituted tobacco leaves, shredded tobacco, and reconstituted tobacco, and liquid aerosol-forming substrates may include liquid compositions based on nicotine, tobacco extracts, and/or various flavoring agents. However, the scope of the present disclosure is not limited to the above-listed examples.

In the following embodiments, "aerosol generation device" may refer to a device that generates an aerosol using an aerosol-forming substrate in order to generate an aerosol that can be inhaled directly into the user's lungs through the user's mouth. Some examples of the aerosol generation device will be described below with reference to FIGS. 9 to 11.

In the following embodiments, "aerosol-generating article" may refer to an article that is able to generate an aerosol. The aerosol-generating article may include an aerosol-forming substrate. A typical example of the aerosol-generating article may include a cigarette, but the scope of the present disclosure is not limited thereto.

In the following embodiments, "puff" refers to inhalation by a user, and the inhalation may be a situation in which a user draws smoke into his or her oral cavity, nasal cavity, or lungs through the mouth or nose.

In the following embodiments, "longitudinal direction" may refer to a direction corresponding to a longitudinal axis of an aerosol-generating article.

In the following embodiments, "sheet" may refer to a thin layer component whose width and length are substantially larger than a thickness thereof. The term "sheet" may be interchangeably used with the term "web" or "film" in the art.

In the following embodiments, "nicotine sheet" may refer to a material in the form of a sheet that contains a nicotine material. Here, the nicotine material is a material including a nicotine component and, for example, may include nicotine, nicotine salt, or a combination thereof.

Hereinafter, various embodiments of the present disclosure will be described.

According to various embodiments of the present disclosure, a nicotine sheet capable of improving persistence of a tobacco smoke taste of an aerosol-generating article can be provided. The provided nicotine sheet may, when heated, slowly release the nicotine component fixed therein and thus can improve persistence of a tobacco smoke taste of an aerosol-generating article. For example, by compensating a tobacco smoke taste in mid and late puffs, the nicotine sheet can provide a lasting tobacco smoke taste to a user.

The nicotine sheet may include a sheet-forming agent and a nicotine material. Hereinafter, each material constituting the nicotine sheet will be described.

The sheet-forming agent may refer to a material that covers a nicotine material to form the sheet. Examples of the sheet-forming agent may include cellulose-based materials such as hydroxypropyl methylcellulose (HPMC), methyl cellulose (MC), ethyl cellulose (EC), carboxymethyl cellulose (CMC), and agar, but the sheet-forming agent is not limited thereto. The cellulose-based materials can form a sheet having excellent physical properties and also cover and fix the nicotine material well, and thus can improve the amount of nicotine held in the sheet and retention of nicotine in the sheet.

In some embodiments, the sheet-forming agent may be a modified cellulose material. Here, "modified cellulose" may refer to cellulose in which a specific functional group is substituted in a molecular structure. Examples of modified cellulose may include HPMC, MC, EC, and CMC, but modified cellulose is not limited thereto. For example, HPMC may have a grade in a range of about 4 to 40000 according to a proportion and molecular weight in which a hydroxypropyl group and a methyl group (or methoxy group) are substituted. The viscosity of modified cellulose may be determined according to the grade. More specifically, physicochemical characteristics of HPMC relate to a proportion of the methoxy group and a proportion and molecular weight of the hydroxypropyl group, and according to the United States Pharmacopeial Convention (USP), types of HPMC may be classified into HPMC1828, HPMC2208, HPMC2906, HPMC2910, and the like according to proportions of the methoxy group and hydroxypropyl group. Here, the first two numbers may refer to a proportion of the methoxy group, and the last two numbers may refer to a proportion of the hydroxypropyl group. As a result of continuous experiments by the inventors of the present disclosure, the nicotine sheet formed using the modified cellulose material was confirmed as having excellent physical properties and holding a large amount of nicotine.

In some embodiments, the sheet-forming agent may be a hydrocolloid material. Examples of the hydrocolloid material may include gelatin, agar, gellan gum, pectin, guar gum, xanthan gum, glucomannan, HPMC, MC, EC, CMC, and starch, but the hydrocolloid material is not limited thereto. Since the hydrocolloid material itself becomes sticky when in contact with a solvent (e.g., distilled water, ethanol (ethyl alcohol)), the hydrocolloid material can be attached to a wrapper or the like of an aerosol-generating article without a separate adhesive. Thus, the hydrocolloid material may simplify a process of placing the nicotine sheet and may be free from a safety problem due to an adhesive.

Next, the nicotine material is a material containing a nicotine component as mentioned above and may include nicotine, nicotine salt, or a combination thereof.

Nicotine salt is a nicotine material that is present in the form of salt and, for example, may be formed (generated) as nicotine is mixed with an organic acid. Due to being absorbed into the body relatively less than nicotine, nicotine salt may give a smoother throat-hitting sensation than nicotine. Examples of the organic acid may include a benzoic acid, a pyruvic acid, a lactic acid, an acetic acid, a citric acid, and the like, but the organic acid is not limited thereto. Also, nicotine salt may be formed as nicotine and an organic acid are mixed in a ratio (e.g., molar ratio) of about 1:1 but is not limited thereto.

Meanwhile, in some embodiments, the nicotine sheet may further include an aerosol-forming agent. The aerosol-forming agent may, by forming an aerosol as the nicotine sheet is heated, promote transfer (release) of the nicotine component contained in the nicotine sheet. For example, as the aerosol is formed and the release of the nicotine component fixed inside the sheet is promoted, the amount of transferred nicotine component may be increased. Further, the aerosol-forming agent may act as a type of plasticizer and impart appropriate flexibility to the nicotine sheet, and accordingly, the overall physical properties of the nicotine sheet can be improved. Example of the aerosol-forming agent may include glycerine, propylene glycol, and the like, but the aerosol-forming agent is not limited thereto. The term "aerosol-forming agent" may be interchangeably used with the term "moisturizer" or "wetting agent" in the art.

Also, in some embodiments, the nicotine sheet may further include low methoxyl pectin (LM-pectin). LM-pectin is a low ester pectin or low methoxyl pectin in which relatively little esterification is performed. Specifically, LM-pectin may be pectin that contains a carboxyl group by less than about 50% in a molecular structure. Due to having a characteristic of not gelating when cooled unlike carrageenan, LM-pectin may lower the viscosity of a slurry-type sheet composition (e.g., to about 600 cp to 800 cp). Also, accordingly, workability of a process of producing the sheet can be improved.

LM-pectin may contain a carboxyl group by less than about 50%, less than about 40%, less than about 30%, less than about 20%, or less than about 10% in a molecular structure. The lower the carboxyl group content in the molecular structure of LM-pectin, the lower the viscosity of a slurry including LM-pectin.

Also, in some embodiments, the nicotine sheet may further include a bulking agent. The bulking agent may be a material that increases the total mass of components other than distilled water (that is, dry mass) to increase the volume of the nicotine sheet being produced but does not affect the original function of the nicotine sheet. Specifically, the bulking agent may have characteristics of increasing the volume of the nicotine sheet but not adversely affecting retention of nicotine in the nicotine sheet while not substantially increasing the viscosity of the slurry (that is, the sheet composition).

The bulking agent may be starch, modified starch, or starch hydrolyzate but is not limited thereto.

Here, modified starch refers to starch acetate, oxidized starch, hydroxypropyl distarch phosphate, hydroxypropyl starch, distarch phosphate, monostarch phosphate, phosphorylated distarch phosphate, or the like.

Also, starch hydrolyzate refers to a material obtained by a process that includes a process of hydrolyzing starch. For example, starch hydrolyzate may include a material obtained by directly hydrolyzing starch (that is, dextrin) or a material obtained by heating and hydrolyzing starch (that is, indigestible dextrin). For example, the bulking agent may be dextrin, more specifically, cyclodextrin.

Generally, starch hydrolyzate may be starch hydrolyzate having a dextrose equivalent (DE) value in a range of about 2 to about 40, preferably, starch hydrolyzate having a DE value in a range of about 2 to about 20. For example, as the starch hydrolyzate having a DE value in a range of about 2 to about 20, Pinedex #100 (Matsutani Chemical Industry Co. Ltd), Pinefiber (Matsutani Chemical Industry Co. Ltd), or TK-16 (Matsutani Chemical Industry Co. Ltd) may be utilized.

Here, "DE" is an abbreviation of "dextrose equivalent," and the DE value indicates a degree of hydrolysis of starch, that is, a saccharification rate of starch. In the present disclosure, the DE value may be a value measured by the Willstatter-Schudel method. Characteristics of hydrolyzed starch (starch hydrolyzate), for example, characteristics such as a molecular weight of starch hydrolyzate and an arrangement of sugar molecules constituting starch hydrolyzate, may not be constant for each molecule of starch hydrolyzate and may be present with a certain distribution or variation.

Due to the distribution or variation of the characteristics of starch hydrolyzate or a difference in cut sections, each molecule of starch hydrolyzate may exhibit different physical properties (e.g., DE value). In this way, starch hydrolyzate is a set of molecules exhibiting different physical properties, but a measurement result (that is, DE value) by the Willstatter-Schudel method is considered a representative value indicating the degree of hydrolysis of starch.

Starch hydrolyzate may be selected from the group consisting of dextrin having a DE value in a range of about 2 to about 5, indigestible dextrin having a DE value in a range of about 10 to about 15, and a mixture thereof. For example, as the dextrin having a DE value in a range of about 2 to about 5, Pinedex #100 (Matsutani Chemical Industry Co. Ltd) may be utilized. For example, as the indigestible dextrin having a DE value in a range of about 10 to about 15, Pinefiber (Matsutani Chemical Industry Co. Ltd) may be utilized.

Meanwhile, a specific composition of the nicotine sheet described above may be designed in various other ways and may vary according to embodiments.

In some embodiments, the nicotine material (e.g., nicotine, nicotine salt) content may be in a range of about 0.01 to 49.99 parts by weight and may be higher than or equal to about 1, 2, or 3 parts by weight, with respect to a total of 100 parts by weight of the nicotine sheet. It was confirmed that within such numerical ranges, persistence of a tobacco smoke taste of an aerosol-generating article is significantly improved.

Also, in some embodiments, the aerosol-forming agent content may be in a range of about 3 to 25 parts by weight and may be in a range of about 3 to 22 parts by weight, in a range of about 5 to 20 parts by weight, in a range of about 8 to 20 parts by weight, in a range of about 10 to 20 parts by weight, in a range of about 6 to 18 parts by weight, in a range of about 6 to 15 parts by weight, or in a range of about 10 to 18 parts by weight, with respect to a total of 100 parts by weight of the nicotine sheet (e.g., the nicotine sheet that is dried). It was confirmed that within such numerical ranges, the amount of transferred nicotine component is significantly increased and physical properties of the sheet are improved.

Also, in some embodiments, the nicotine sheet may include about 2 to about 15 parts by weight of moisture, about 25 to about 90 parts by weight of modified cellulose, and about to about 30 parts by weight of nicotine material, with respect to a total of 100 parts by weight.

Also, in some embodiments, the nicotine sheet may include about 2 to about 15 parts by weight of moisture, about 1 to about 60 parts by weight of hydrocolloid material, about 1 to about 60 parts by weight of LM-pectin, and about 0.1 to about 30 parts by weight of nicotine material, with respect to a total of 100 parts by weight.

For example, the nicotine sheet described above may be produced by applying (casting) a liquid (e.g., slurry-form) sheet composition including a solvent (e.g., distilled water, ethanol (ethyl alcohol), or the like), a sheet-forming agent, and a nicotine material on a predetermined substrate and drying. However, the nicotine sheet is not limited thereto, and a specific method of producing the nicotine sheet may be changed.

According to various embodiments of the present disclosure, an aerosol-generating article with improved persistence of a tobacco smoke taste may be provided. Specifically, by the nicotine sheet described above being applied in various forms, persistence of a tobacco smoke taste of an aerosol-generating article can be improved, and hereinafter, such aerosol-generating articles (e.g., 100) will be described in detail with reference to the accompanying drawings.

FIG. 1 is an exemplary view schematically illustrating an aerosol-generating article 100 according to some embodiments of the present disclosure.

As illustrated in FIG. 1, the aerosol-generating article 100 may include an aerosol-forming substrate part 110, a filter part 120, and a wrapper 130. However, only the components relating to the embodiments of the present disclosure are illustrated in FIG. 1. Therefore, those of ordinary skill in the art to which the present disclosure pertains should understand that the aerosol-generating article 100 may further include general-purpose components other than the components illustrated in FIG. 1. Also, FIG. 1 only schematically illustrates some examples of aerosol-generating articles according to various embodiments of the present disclosure, and a specific structure of the aerosol-generating article may be changed from that illustrated in FIG. 1. Hereinafter, each component of the aerosol-generating article 100 will be described.

The aerosol-forming substrate part 110 may perform a function of forming an aerosol. Specifically, the aerosol-forming substrate part 110 may include an aerosol-forming substrate and may form an aerosol using the aerosol-forming substrate. For example, the aerosol-forming substrate part 110 may form an aerosol when heated by an aerosol generation device (e.g., 1000 of FIG. 9). The formed aerosol may be delivered to an oral region of a user via the filter part 120 due to a puff.

As illustrated, the aerosol-forming substrate part 110 may be disposed upstream of the filter part 120 and abut an upstream end of the filter part 120. The aerosol-forming substrate part 110 may further include the wrapper 130 that wraps around the aerosol-forming substrate.

The aerosol-forming substrate part 110 is produced in the form of a rod and thus may also be referred to as an "aerosol-forming rod 110" or a "tobacco rod 110" in some cases. Alternatively, the aerosol-forming substrate part 110 may also be referred to as a "medium portion 110" in some cases.

Next, the filter part 120 may perform a function of filtering an aerosol. To this end, the filter part 120 may include a filter material. Examples of the filter material may include a cellulose acetate fiber, paper, etc., but the scope of the present disclosure is not limited thereto.

As illustrated, the filter part 120 may be disposed downstream of the aerosol-forming substrate part 110 and abut a downstream end of the aerosol-forming substrate part 110. Also, the filter part 120 may be disposed at a downstream end portion of the aerosol-generating article 100 and serve as a mouthpiece that comes into contact with the oral region of the user. The filter part 120 may further include the wrapper 130 that wraps around a filter material (plug).

Since the filter part 120 is also produced in the form of a rod, the filter part 120 may be referred to as a "filter rod 120" in some cases and may be produced in various shapes such as a cylindrical shape, a tubular shape including a hollow therein (e.g., a tubular cellulose acetate filter), and a recessed shape. Alternatively, since the filter part 120 serves as a mouthpiece, the filter part 120 may also be referred to as a "mouthpiece part 120."

Next, the wrapper 130 may refer to a wrapper that wraps around at least a portion of the aerosol-forming substrate part 110 and/or the filter part 120. The wrapper 130 may refer to a separate wrapper of the aerosol-forming substrate part 110 or the filter part 120 or may refer to a wrapper, such as a tipping wrapper, that wraps around at least a portion of the aerosol-forming substrate part 110 and at least a portion of the filter part 120 together. The wrapper 130 may also collectively refer to all wrappers used in the aerosol-generating article 100.

The wrapper 130 may be made of porous or nonporous wrapping paper, but the scope of the present disclosure is not limited thereto. For example, the wrapper 130 may be made of a metal foil or have a form in which wrapping paper and a metal foil are laminated with each other.

According to various embodiments of the present disclosure, as illustrated, a nicotine sheet 10 may be disposed on (applied to) the aerosol-forming substrate part 110 and/or the wrapper 130. However, specific methods of applying the nicotine sheet 10 and processed forms thereof may vary.

Figure 2:
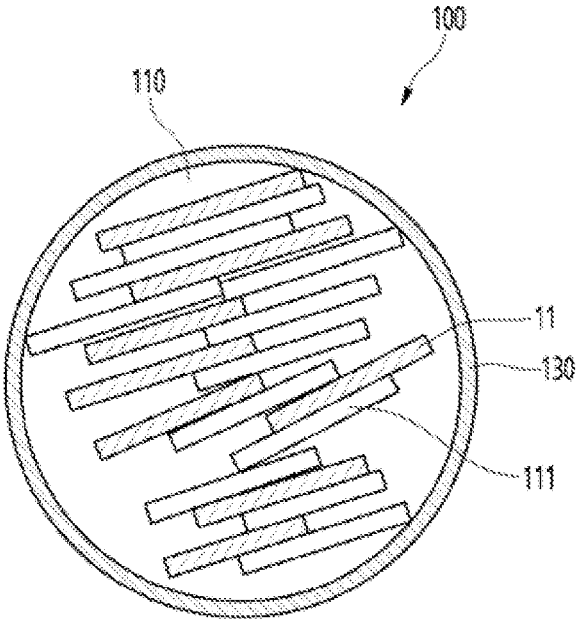
FIGS. 2 to 4 are exemplary views for describing ways of applying a nicotine sheet according to some embodiments of the present disclosure.

In some embodiments, as illustrated in FIG. 2, the nicotine sheet 10 may be applied in the form of cut pieces 111 to the aerosol-forming substrate part 110. For example, the cut pieces 111 of the nicotine sheet 10 may be mixed with a tobacco material 11 in the form of shredded tobacco (e.g., shredded tobacco leaves, shredded reconstituted tobacco leaves) and added to the aerosol-forming substrate part 110.

Figure 3:
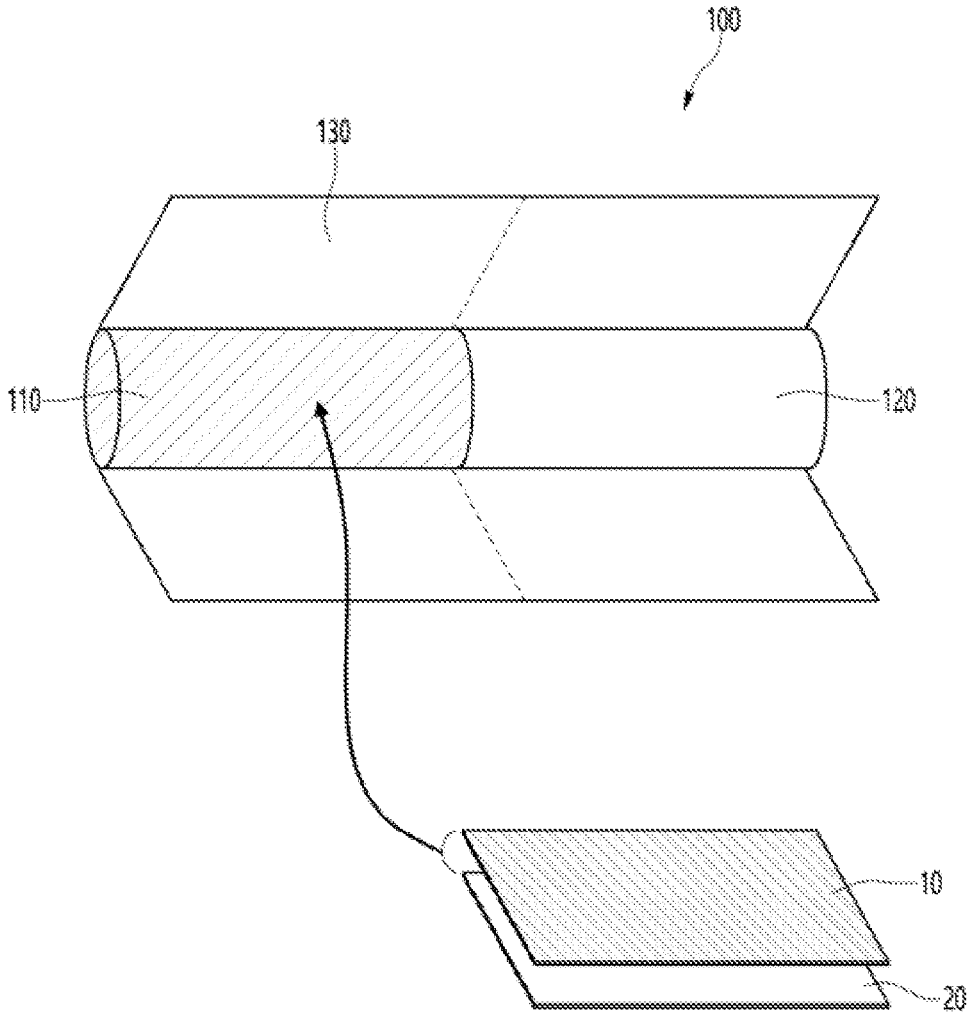

In some other embodiments, as illustrated in FIG. 3, the nicotine sheet 10 may be added to the aerosol-forming substrate part 110 together with a tobacco sheet 20. Here, the tobacco sheet 20 is a tobacco material produced in the form of a sheet and, for example, may be reconstituted tobacco such as reconstituted tobacco leaves but is not limited thereto. In the present example, the nicotine sheet 10 may be appropriately mixed with the tobacco sheet 20 (e.g., the nicotine sheet 10 may be stacked on the tobacco sheet 20, rolled together with the tobacco sheet 20, etc.) and added to the aerosol-forming substrate part 110.

Figure 4:
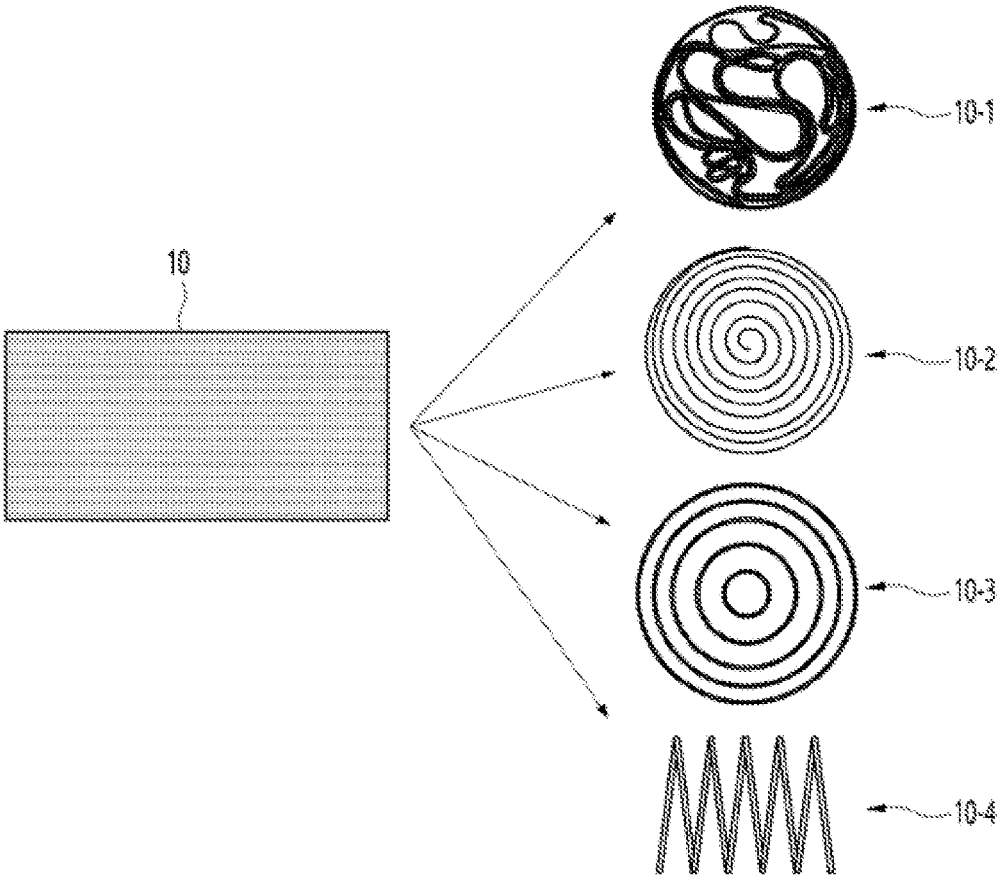

In still some other embodiments, as illustrated in FIG. 4, the nicotine sheet 10 may be applied in a rolled or folded form to the aerosol-forming substrate part 110. For example, the nicotine sheet 10 may be applied to the aerosol-forming substrate part 110 in a form in which the nicotine sheet 10 is rolled or folded in irregular patterns (see "10-1"), a form in which the nicotine sheet 10 is rolled in a vortex form (see "10-2"), a form in which the nicotine sheet 10 is rolled in a concentric form (see "10-3"), or a form in which the nicotine sheet 10 is folded several times (e.g., a form in which the nicotine sheet 10 is folded to secure an airflow path in the longitudinal direction; see "10-4"). Here, the nicotine sheet 10 may be added to the aerosol-forming substrate part 110 together with a tobacco material or may form an independent segment (that is, a dedicated segment including only the nicotine sheet 10) in the aerosol-forming substrate part 110. Alternatively, the nicotine sheet 10 may be added to a separate segment (e.g., a cooling segment) formed outside the aerosol-forming substrate part 110. When the nicotine sheet 10 is applied in the above-listed forms, an airflow path may be secured in the longitudinal direction, and thus a smooth airflow and appropriate resistance to draw can be ensured. Also, an area of contact between the nicotine sheet 10 and a high-temperature airflow is increased, and thus the amount of transferred nicotine may be increased.

In yet some other embodiments, the nicotine sheet 10 may be applied (e.g., attached) to the wrapper 130. For example, the nicotine sheet 10 may be disposed on an inner side of the wrapper 130. In a case in which the wrapper 130 includes a metal foil, the nicotine sheet 10 may be disposed on an inner side of the metal foil. Alternatively, the nicotine sheet 10 may constitute at least a portion of the wrapper 130. For example, the nicotine sheet 10 itself may serve as (be used as) the wrapper 130, or a wrapping material produced in a form in which the nicotine sheet 10 and wrapping paper are integrated may be used as the wrapper 130.

Meanwhile, in the previous embodiments, the nicotine sheet 10 may be processed through a predetermined process. However, a specific processed form of the nicotine sheet 10 may vary.

Figure 5:
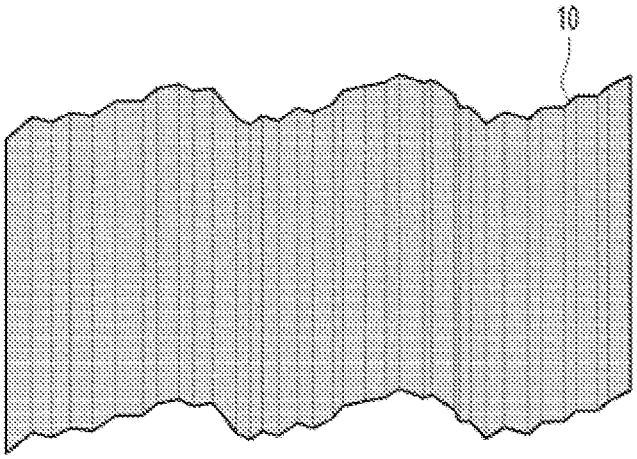
FIGS. 5 and 6 are exemplary views for describing processed forms of the nicotine sheet according to some embodiments of the present disclosure.

For example, as illustrated in FIG. 5, the nicotine sheet 10 may be processed to be pleated or folded in the longitudinal direction (that is, the machine direction (MD)) of the aerosol-generating article 100. For example, the nicotine sheet 10 may be pleated or folded according to at least one of a crimping process, a pleating process, a folding process, and a gathering process. Specifically, the crimping process is a process in which creep is assigned to a sheet surface through a difference between pressure and speed of a roller of a crimping device, and the crimping process may be divided into a wet process and a dry process. The wet process refers to a process in which base paper is soaked in water and then softened and crimped and undergoes a re-drying process. The dry process refers to a drying process using two dryers with different temperatures. Since the pleating process, folding process, and gathering process should already be familiar to those of ordinary skill in the art, further descriptions thereof will be omitted. According to the present embodiment, a plurality of channels may be formed in the nicotine sheet 10 in a longitudinal direction thereof by at least one of the processes described above, and a smooth airflow and appropriate resistance to draw may be ensured by the formed channels. Further, an area of contact between the nicotine sheet 10 and a high-temperature airflow is increased, and thus the amount of transferred nicotine can be increased.

Figure 6:
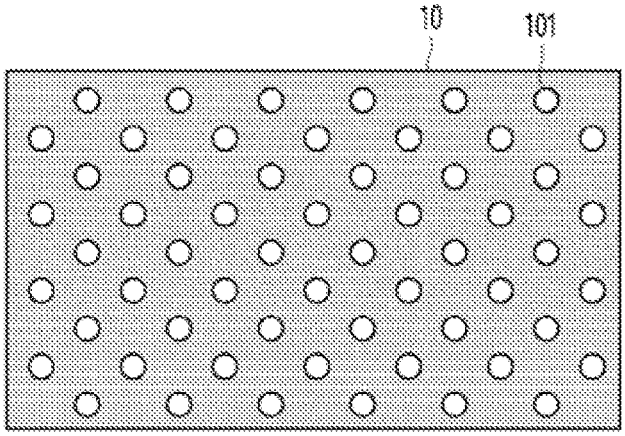

As another example, as illustrated in FIG. 6, the nicotine sheet 10 may be processed so that a plurality of holes 101 are formed therein. For example, the plurality of holes 101 may be formed in the nicotine sheet 10 by a punching process. Here, a diameter of the hole 101 may be in a range of about 0.05 mm to 5 mm. Preferably, the diameter of the hole 101 may be about 0.1 mm to 3 mm, about 0.2 mm to 2.5 mm, about 0.3 mm to 2.1 mm, or about 0.4 mm toe 1.8 mm. Within such numerical ranges, a smooth airflow and appropriate resistance to draw can be ensured. Further, an area of contact between the nicotine sheet 10 and a high-temperature airflow is increased, and thus the amount of transferred nicotine can be increased.

The aerosol-generating article 100 according to some embodiments of the present disclosure has been described above with reference to FIGS. 1 to 6. According to the above description, by the nicotine sheet 10 being applied in various forms to the aerosol-generating article 100, the aerosol-generating article 100 with improved persistence of a tobacco smoke taste can be easily manufactured.

Hereinafter, aerosol-generating articles 200 and 300 according to other embodiments of the present disclosure will be described with reference to FIGS. 7 and 8. However, for clarity of the present disclosure, description of contents overlapping with those described above in relation to the aerosol-generating article 100 will be omitted.

Figure 7:
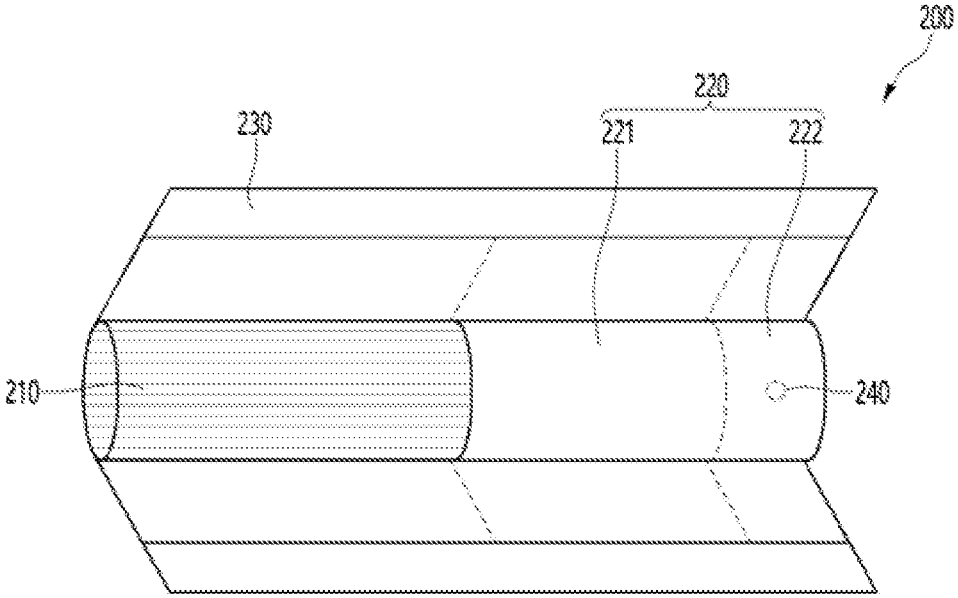
FIG. 7 is an exemplary view illustrating an aerosol-generating article according to some other embodiments of the present disclosure.

FIG. 7 is an exemplary view illustrating an aerosol-generating article according to some other embodiments of the present disclosure.

As illustrated in FIG. 7, the aerosol-generating article 200 may include an aerosol-forming substrate part 210, a filter part 220, and a wrapper 230, and the filter part 220 may include a plurality of segments 221 and 222.

The aerosol-forming substrate part 210 may correspond to the aerosol-forming substrate part 110 described above. Therefore, description thereof will be omitted.

Next, the filter part 220 may be made of a first segment 221 and a second segment 222. Of course, the filter part 220 may further include a third segment (not illustrated).

The first segment 221 may perform a function of cooling an aerosol generated from the aerosol-forming substrate part 210. Therefore, the first segment 221 may be referred to as a "cooling segment 221" or a "cooling part 221" in some cases.

The first segment 221 may be produced in various forms. As an example, the first segment 221 may be a cylindrical paper tube that is made of a paper material and includes a hollow (or a cavity) formed therein. As another example, the first segment 221 may be produced using a polymer material or a biodegradable polymer material. For example, the first segment 221 may be produced using a polylactic acid (PLA) fiber but is not limited thereto. As still another example, the first segment 221 may be produced as a cellulose acetate filter having a plurality of holes formed therein. As yet another example, the first segment 221 may be a tubular filter including a hollow formed therein. For example, the first segment 221 may be a cellulose acetate filter including a hollow formed therein. However, the first segment 221 is not limited thereto and may be produced in any other form as long as the first segment 221 can perform a cooling function.

In some embodiments, the nicotine sheet 10 may be applied to the first segment 221. For example, the nicotine sheet 10 may be disposed in any of the forms illustrated in FIG. 4 inside (e.g., inside the hollow or cavity of) the first segment 221. Alternatively, the nicotine sheet 10 may be attached to an inner wall the first segment 221 (e.g., an inner wall of the hollow). In any case, a smooth airflow may be ensured in the longitudinal direction, and by the nicotine sheet 10 absorbing heat from a high-temperature aerosol, cooling performance of the first segment 221 can be improved. Of course, the nicotine component is slowly released when the nicotine sheet 10 is in contact with the high-temperature aerosol, and thus persistence of a tobacco smoke taste of the aerosol-generating article 200 can also be sufficiently ensured.

For reference, since cellulose-based materials have a property of undergoing a phase change and absorbing a large amount of heat upon contact with a high-temperature airflow, when the nicotine sheet 10 formed using a cellulose-based material is applied, the cooling performance of the first segment 221 may be further improved.

Next, the second segment 222 may perform a function of filtering an aerosol that passed through the first segment 221. Therefore, the second segment 222 may be referred to as a "filter segment 222" or a "filter part 222" in some cases. Alternatively, due to being located at a mouthpiece portion, the second segment 222 may be referred to as a "mouthpiece segment 222" or a "mouthpiece part 222."

In some embodiments, the second segment 222 may include at least one capsule 240. Here, the capsule 240 may perform a function of producing a flavor or perform a function of generating an aerosol. For example, the capsule 240 may have a structure in which a liquid including a flavoring is wrapped by a film. Also, the capsule 240 may have a spherical or cylindrical shape, but the shape of the capsule 240 is not limited thereto.

Next, the wrapper 230 may correspond to the wrapper 130 described above. Therefore, description thereof will be omitted.

Meanwhile, although not illustrated in FIG. 7, the aerosol-generating article 200 may further include a plug (not illustrated) disposed at an end. For example, the plug may be disposed at an upstream end of the aerosol-generating article 200 and perform a function of appropriately controlling the overall length of the aerosol-generating article 200. Also, in a case in which the aerosol-generating article 200 is inserted into an aerosol generation device (e.g., 1000 of FIG. 9), the plug may perform a function of controlling the aerosol-forming substrate part 210 to be disposed at an appropriate position inside the aerosol generation device (e.g., 1000 of FIG. 9).

Figure 8:
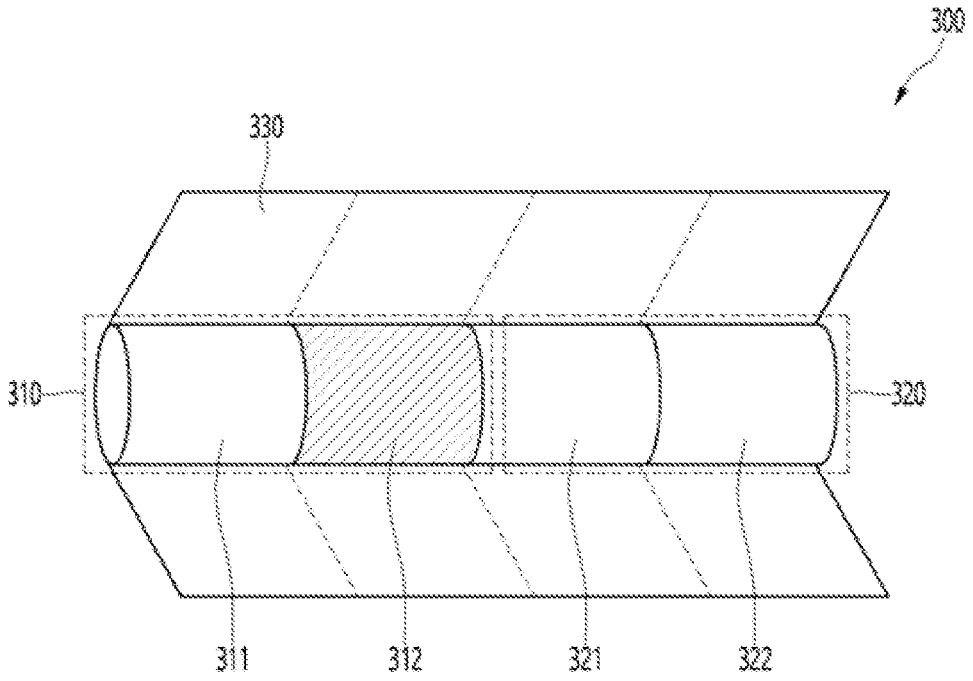
FIG. 8 is an exemplary view illustrating an aerosol-generating article according to still some other embodiments of the present disclosure.

FIG. 8 is an exemplary view schematically illustrating the aerosol-generating article 300 according to still some other embodiments of the present disclosure.

As illustrated in FIG. 8, the aerosol-generating article 300 may include an aerosol-forming substrate part 310 and a filter part 320. The aerosol-forming substrate part 310 may include a plurality of segments 311 and 312, and the filter part 320 may include a plurality of segments 321 and 322.

As illustrated, the aerosol-forming substrate part 310 may be made of a first segment 311 and a second segment 312. Of course, the aerosol-forming substrate part 310 may further include a third segment (not illustrated).

The first segment 311 may include a moisturizer (an aerosol-forming agent). For example, the first segment 311 may include crimped paper impregnated with a moisturizer. For example, the moisturizer may include at least one of glycerin, propylene glycol, ethylene glycol, dipropylene glycol, diethylene glycol, triethylene glycol, tetraethylene glycol, and oleyl alcohol.

Next, the second segment 312 may include a nicotine-generating substrate such as a tobacco material. For example, the nicotine-generating substrate may include shredded tobacco, tobacco particles, tobacco sheets, tobacco beads, and tobacco granules. As another example, the nicotine-generating substrate may include crimped paper impregnated with a tobacco extract or a nicotine liquid. When the nicotine-generating substrate is heated, nicotine may be generated from the nicotine-generating substrate and transferred to the filter part 320.

Next, the filter part 320 may include the plurality of segments 321 and 322. For example, the filter part 320 may include a third segment 321 configured to perform a cooling function and a fourth segment 322 configured to perform a filtering function. The contents described above in relation to the filter part 220 of FIG. 7 may identically apply to the filter part 320, and thus further description thereof will be omitted.

Next, a wrapper 330 may correspond to the wrapper 130 described above. Therefore, description thereof will be omitted.

The aerosol-generating articles 200 and 300 according to other embodiments of the present disclosure have been described above with reference to FIGS. 7 and 8. Hereinafter, various types of aerosol generation devices 1000 to which the above-described aerosol-generating articles 100 to 300 are applicable will be described with reference to FIGS. 9 to 11.

Figure 9:
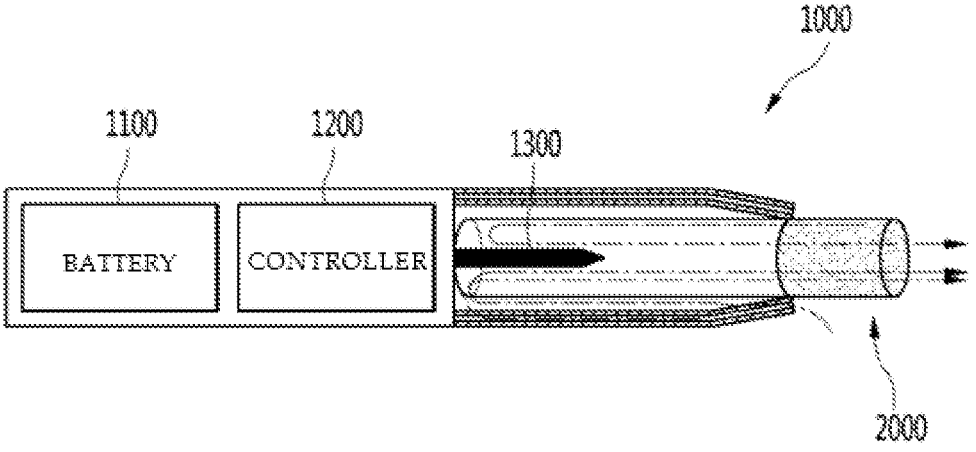
FIGS. 9 to 11 illustrate various types of aerosol generation devices to which the aerosol-generating article according to some embodiments of the present disclosure is applicable.
Figure 10:
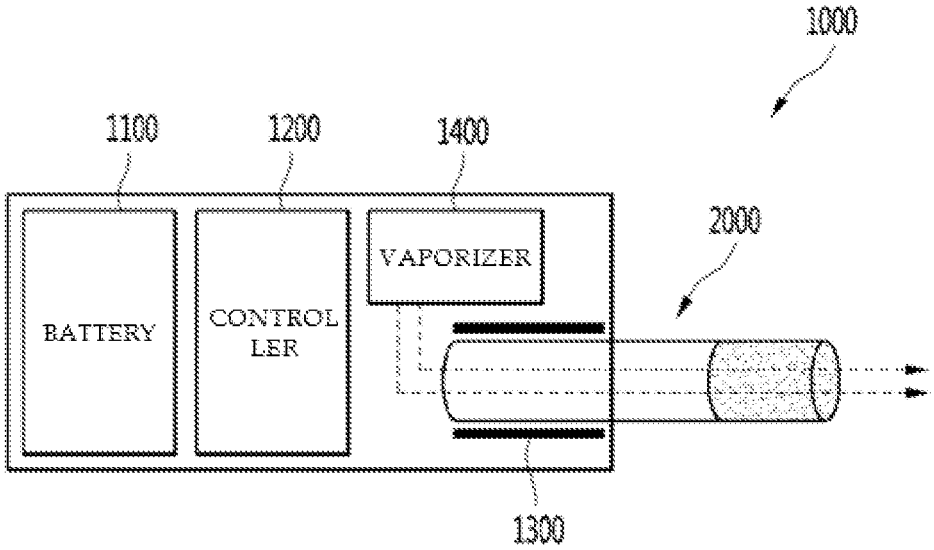
Figure 11:
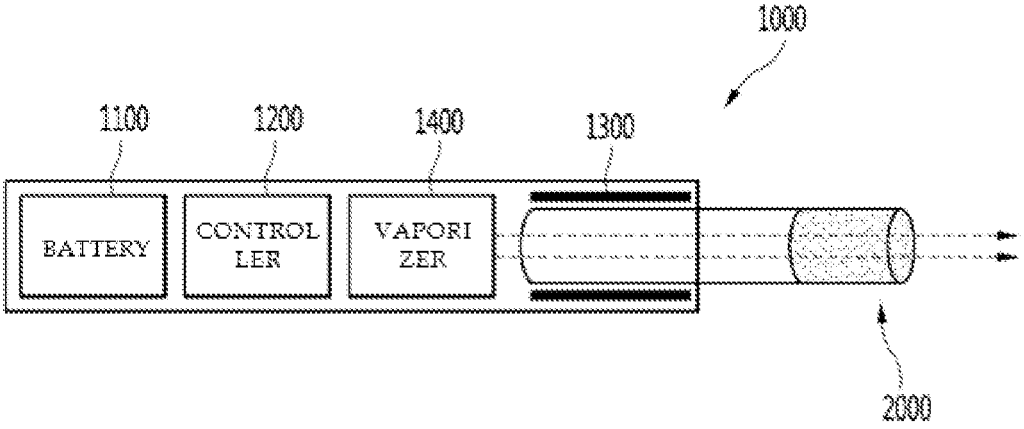

FIGS. 9 to 11 are exemplary block diagrams illustrating aerosol generation devices 1000. Specifically, FIG. 9 illustrates a cigarette-type aerosol generation device 1000, and FIGS. and 11 illustrate hybrid-type aerosol generation devices 1000 that use a liquid and a cigarette together. Hereinafter, each aerosol generation device 1000 will be described.

As illustrated in FIG. 9, the aerosol generation device 1000 may include a heater 1300, a battery 1100, and a controller 1200. However, this is only an exemplary embodiment for achieving the objectives of the present disclosure, and, of course, some components may be added or omitted as necessary. Also, the components of the aerosol generation device 1000 illustrated in FIG. 9 represent functional components that are functionally distinct, and the plurality of components may be implemented in a form in which they are integrated with each other in an actual physical environment, or a single component may be implemented in a form in which it is divided into a plurality of specific functional components. Hereinafter, each component of the aerosol generation device 1000 will be described.

The heater 1300 may be disposed to heat a cigarette 2000 inserted thereinto. The cigarette 2000 may include a solid aerosol-forming substrate and generate an aerosol when heated. The generated aerosol may be inhaled by a user through the oral region of the user. The operation, heating temperature, etc. of the heater 1300 may be controlled by the controller 1200.

Next, the battery 1100 may supply power used to operate the aerosol generation device 1000. For example, the battery 1100 may supply power to allow the heater 1300 to heat the aerosol-forming substrate included in the cigarette 2000 and may supply power required for the operation of the controller 1200.

Also, the battery 1100 may supply power required to operate electrical components such as a display (not illustrated), a sensor (not illustrated), and a motor (not illustrated) which are installed in the aerosol generation device 1000.

Next, the controller 1200 may control the overall operation of the aerosol generation device 1000. For example, the controller 1200 may control the operation of the heater 1300 and the battery 1100 and may also control the operation of other components included in the aerosol generation device 1000. The controller 1200 may control the power supplied by the battery 1100, the heating temperature of the heater 1300, and the like. Also, the controller 1200 may check a state of each of the components of the aerosol generation device 1000 and determine whether the aerosol generation device 1000 is in an operable state.

The controller 1200 may be implemented with at least one processor. The processor may also be implemented with an array of a plurality of logic gates or implemented with a combination of a general-purpose microprocessor and a memory which stores a program that may be executed by the microprocessor. Also, those of ordinary skill in the art to which the present disclosure pertains should clearly understand that the controller 1200 may also be implemented with other forms of hardware.

Hereinafter, the hybrid-type aerosol generation devices 1000 will be briefly described with reference to FIGS. 10 and 11.

FIG. 10 illustrates the aerosol generation device 1000 in which a vaporizer 1400 and the cigarette 2000 are disposed in parallel, and FIG. 11 illustrates the aerosol generation device 1000 in which the vaporizer 1400 and the cigarette 2000 are disposed in series. However, an internal structure of the aerosol generation device 1000 is not limited to those illustrated in FIGS. and 11, and the arrangement of components may be changed according to a design method.

In FIGS. 10 and 11, the vaporizer 1400 may include a liquid reservoir configured to store a liquid aerosol-forming substrate, a wick configured to absorb the aerosol-forming substrate, and a vaporizing element configured to vaporize the absorbed aerosol-forming substrate to generate an aerosol. The vaporizing element may be implemented in various forms such as a heating element or a vibration element. Also, in some embodiments, the vaporizer 1400 may be designed to have a structure that does not include the wick.

The aerosol generated in the vaporizer 1400 may pass through the cigarette 2000 and be inhaled through the oral region of the user. The vaporizing element of the vaporizer 1400 may also be controlled by the controller 1200.

The exemplary aerosol generation devices 1000, to which the aerosol-generating articles 100 to 300 according to some embodiments of the present disclosure may be applied, have been described above with reference to FIGS. 9 to 11.

Hereinafter, the configurations and effects of the nicotine sheet 10 described above will be further clarified using examples and experimental examples. However, the following examples are only some examples of the nicotine sheet 10, and thus the scope of the present disclosure is not limited by the following examples.

Examples 1 to 11

Nicotine sheets having weight ratios shown in Table 1 and Table 2 below were produced, and the produced nicotine sheets were added to aerosol-forming substrate parts to manufacture heating-type cigarettes.

TABLE 1

| Component | Example 1 | Example 2 | Example 3 | Example 4 | Example 5 | Example 6 |
|---|---|---|---|---|---|---|
| HPMC(Grade A) | 18 | — | — | — | — | — |
| HPMC(Grade B) | — | — | — | — | — | — |
| HPMC(Grade C) | — | — | — | — | — | — |
| MC(Grade A) | — | 18 | — | — | — | 18 |
| MC(Grade B) | — | — | — | — | — | — |
| MC(Grade C) | — | — | — | — | — | — |
| CMC | — | — | 18 | — | — | — |
| EC | — | — | — | 18 | — | — |
| Agar | — | — | — | — | 18 | — |
| Dextrin | 3 | 3 | 3 | 3 | 3 | 12 |
| β-cyclodextrin | 9 | 9 | 9 | 9 | 9 | — |
| Nicotine | 1.2 | 1.2 | 1.2 | 1.2 | 1.2 | 1.2 |
| Organic acid | 0.6 | 0.6 | 0.6 | 0.6 | 0.6 | 0.6 |
| Water | 150 | 150 | 150 | 150 | 150 | 150 |
| Ethyl alcohol | 20 | 20 | 20 | 20 | 20 | 20 |
| PG | 3 | 3 | 3 | 3 | 3 | 3 |
| GLY | 3 | 3 | 3 | 3 | 3 | 3 |
| Total | 207.8 | 207.8 | 207.8 | 207.8 | 207.8 | 207.8 |

(Grades A, B, C: Viscosities 15, 5, 50 in 2% solution)

TABLE 2

| Component | Example 7 | Example 8 | Example 9 | Example 10 | Example 11 |
|---|---|---|---|---|---|
| HPMC(Grade A) | — | — | — | — | — |
| HPMC(Grade B) | — | 18 | — | — | — |
| HPMC(Grade C) | — | — | 18 | — | — |
| MC(Grade A) | 18 | — | — | — | — |
| MC(Grade B) | — | — | — | 18 | — |
| MC(Grade C) | — | — | — | — | 18 |
| CMC | — | — | — | — | — |
| EC | — | — | — | — | — |
| Agar | — | — | — | — | — |
| Dextrin | 12 | 3 | 3 | 3 | 3 |
| β-cyclodextrin | — | 9 | 9 | 9 | 9 |
| Nicotine | 1.2 | 1.2 | 1.2 | 1.2 | 1.2 |
| Organic acid | — | 0.6 | 0.6 | 0.6 | 0.6 |
| Water | 150 | 150 | 150 | 150 | 150 |
| Ethyl alcohol | 20 | 20 | 20 | 20 | 20 |
| PG | 3 | 3 | 3 | 3 | 3 |
| GLY | 3 | 3 | 3 | 3 | 3 |
| Total | 207.2 | 207.8 | 207.8 | 207.8 | 207.8 |

(Grades A, B, C: Viscosities 15, 5, 50 in 2% solution)

Experimental Example 1: Evaluation of Level of Difficulty of Preparation and Sensory Characteristics An experiment to comprehensively evaluate a level of difficulty of preparing a sheet-producing liquid and sensory characteristics such as a tobacco smoke taste persistence, an off-taste, a tobacco smoke taste intensity, smoothness of a throat-hitting sensation, and satisfaction after smoking was conducted on nicotine sheets and cigarettes according to Examples 1 to 11. The evaluation of the sensory characteristics was performed by a panel of smokers with a smoking experience of five years or more, the evaluation was performed based on high/medium/low grade, and results of the evaluation are shown in Table 3 and Table 4 below.

TABLE 3

| Evaluation item | Example 1 | Example 2 | Example 3 | Example 4 | Example 5 | Example 6 |
|---|---|---|---|---|---|---|
| Level of difficulty of preparing sheet-producing liquid | Medium | Low | High | Medium | High | Low |
| Tobacco smoke taste persistence | Low | High | Low | Low | High | Medium |
| Off-taste during smoking | High | Low | High | Medium | Medium | Low |
| Tobacco smoke taste intensity | Medium | Medium | Medium | Medium | Medium | Medium |
| Smoothness of throat-hitting sensation | Medium-high | Medium-high | Medium-high | Medium-high | Medium-high | Medium-high |
| Satisfaction after smoking | Medium-high | Medium-high | Medium-high | Medium-high | Medium-high | Medium-high |

TABLE 4

| Evaluation item | Example 7 | Example 8 | Example 9 | Example 10 | Example 11 |
|---|---|---|---|---|---|
| Level of difficulty of preparing sheet-producing liquid | Low | High | Low | High | High |
| Tobacco smoke taste persistence | Medium | High | Medium-high | Medium-high | Medium-high |
| Off-taste during smoking | Low | High | High | Low | Low |
| Tobacco smoke taste intensity | High | Medium | Medium | High | High |
| Smoothness of throat-hitting sensation | Medium-low | Medium-high | Medium-high | Medium-low | Medium-low |
| Satisfaction after smoking | Medium-high | Medium-high | Medium-high | Medium-high | Medium-high |

Referring to Table 3 and Table 4, the level of difficulty of preparing a sheet-producing liquid was evaluated to be generally low for MC-based sheet compositions (refer to Examples 2, 6, 7, and 9). Specifically, it was evaluated that, while the MC-based sheet compositions have appropriate viscosity and a characteristic of little gelation, thus facilitating preparation of a sheet-producing liquid, HPMC-based sheet compositions have high viscosity or a property of gelating at room temperature, thus making it difficult to prepare a sheet-producing liquid. Also, it was confirmed that there was an inconvenience of having to heat water to about 80° C. to 90° C. in order to dissolve agar in water.

In addition, the nicotine sheet (or cigarette) according to Example 1, 3, 8, or 9 was found to cause a strong off-taste during smoking as compared to other examples. In other words, the nicotine sheet using HPMC or CMC was evaluated as causing a stronger off-taste than the nicotine sheets using MC or the like.

Examples 12 to 20

Nicotine sheets having weight ratios shown in Table 5 and Table 6 below were produced, and the produced nicotine sheets were added to aerosol-forming substrate parts to manufacture heating-type cigarettes.

TABLE 5

| Component | Example 12 | Example 13 | Example 14 | Example 15 | Example 16 | Example 17 |
|---|---|---|---|---|---|---|
| MC | 18 | 18 | 18 | 18 | 18 | 18 |
| Dextrin | 3 | 3 | 3 | 3 | 3 | 3 |
| β-cyclodextrin | 9 | 9 | 9 | 9 | 9 | 9 |
| Nicotine | 1.2 | 1.2 | 1.2 | 1.2 | 1.2 | 1.2 |
| Organic acid | 0.6 | 0.6 | 0.6 | 0.6 | 0.6 | 0.6 |
| Water | 150 | 150 | 150 | 150 | 150 | 150 |
| Ethyl alcohol | 20 | 20 | 20 | 20 | 20 | 20 |
| PG | 0.1 | 1 | 3 | 1 | 3 | 3 |

TABLE 5-continued

| Component | Example 12 | Example 13 | Example 14 | Example 15 | Example 16 | Example 17 |
|---|---|---|---|---|---|---|
| GLY | 0.1 | 1 | 1 | 3 | 3 | 5 |
| Total | 202 | 203.8 | 205.8 | 205.8 | 207.8 | 209.8 |

TABLE 6

| Component | Example 18 | Example 19 | Example 20 |
|---|---|---|---|
| MC | 18 | 18 | 18 |
| Dextrin | 12 | 12 | 3 |
| β-cyclodextrin | 9 | 9 | 9 |
| Nicotine | 1.2 | 1.2 | 1.2 |
| Organic acid | 0.6 | 0.6 | 0.6 |
| Water | 150 | 150 | 150 |
| Ethyl alcohol | 20 | 20 | 20 |
| PG | 5 | 3 | 3 |
| GLY | 3 | 10 | 20 |
| 합계 | 218.8 | 223.8 | 224.8 |

Experimental Example 2: Physical Properties of Sheet and Sensory Evaluation According to the Aerosol-Forming Agents Content An experiment to comprehensively evaluate physical properties of sheets according to the aerosol-forming agents (e.g., PG, GLY) content and sensory characteristics such as an amount of generated aerosol, an off-taste, a tobacco smoke taste intensity, and satisfaction after smoking was conducted on nicotine sheets and cigarettes according to Examples 12 to 20. The evaluation of the sensory characteristics was performed in the same manner as in Experimental Example 1, and results of the evaluation are shown in Table 7 and Table 8 below.

TABLE 7

| Evaluation item | Example 12 | Example 13 | Example 14 | Example 15 | Example 16 | Example 17 |
|---|---|---|---|---|---|---|
| Physical properties of sheet | Low | Low | Medium-high | Medium | High | High |
| Amount of generated aerosol | Low | Low | Low | Medium-low | Medium | Medium-high |
| Off-taste during smoking | Low | Low | Low | Low | Low | Low |
| Tobacco smoke taste intensity | Medium | Medium | Medium | Medium | Medium | Medium |
| Satisfaction after smoking | Medium-high | Medium-high | Medium-high | Medium-high | Medium-high | Medium-high |

TABLE 8

| Evaluation item | Example 18 | Example 19 | Example 20 |
|---|---|---|---|
| Physical properties of sheet | High | Medium-low | Low |
| Amount of generated aerosol | Medium | High | High |
| Off-taste during smoking | Low | Low | Low |
| Tobacco smoke taste intensity | Medium | High | Medium |
| Satisfaction after smoking | Medium-high | Medium-high | Medium-high |

Referring to Table 7 and Table 8, physical properties of the nicotine sheets according to Example 14 and Examples 16 to 18 were found to be generally excellent, and among those nicotine sheets, the nicotine sheets according to Examples 16 to 18 were found to have better physical properties. Specifically, it was confirmed that, when the aerosol-forming agents content was too low (e.g., Examples 12 and 13), sheet breakage occurred, and when the aerosol-forming agents content was too high (e.g., Examples 19 and 20), the sheet become sticky or mushy.

For reference, the aerosol-forming agents content in the nicotine sheets according to Examples 16 to 18 is about 8 to 20 parts by weight with respect to a total of 100 parts by weight of the dried (produced) sheet. This is because ethyl alcohol and water added during preparation of a sheet-producing liquid are mostly volatilized or evaporated when dried (e.g., generally, ethyl alcohol is volatilized when dried, and about 6 to 10 parts by weight of water remain based on a total of 100 parts by weight of the sheet when water is dried).

Also, it was found that the amount of generated aerosol increased with an increase in the aerosol-forming agents content. Also, it was confirmed that, when a proportion of GLY was higher than that of PG, the amount of generated aerosol was large, but the physical properties of the sheet were relatively inferior. For example, the amount of generated aerosol was found to be higher in Example 17 (or Example 15) than in Example 18 (or Example 14) (the aerosol-forming agents content was the same in Examples 17 and 18, but the proportion of GLY was higher in Example 17, and the aerosol-forming agents content was the same in Examples 15 and 14, but the proportion of GLY was higher in Example 15), and physical properties of the nicotine sheet according to Example 15 were found to be inferior as compared to Example 14.

The configurations and effects of the nicotine sheet 10 have been described in more detail above using the examples and the experimental examples.

The embodiments of the present disclosure have been described above with reference to the accompanying drawings, but those of ordinary skill in the art to which the present disclosure pertains should understand that the present disclosure may be embodied in other specific forms without changing the technical spirit or essential features thereof. Therefore, the embodiments described above should be understood as being illustrative, instead of limiting, in all aspects. The scope of the present disclosure should be interpreted according to the claims below, and any technical spirit within the scope equivalent to the claims should be interpreted as falling within the scope of the technical spirit defined by the present disclosure.

The invention claimed is:

1. A nicotine sheet comprising:

a nicotine material which includes a nicotine component; and a cellulose-based material which forms a sheet, wherein the cellulose-based material includes at least one material selected from hydroxypropyl methylcellulose (HPMC), methyl cellulose (MC), ethyl cellulose (EC), carboxymethyl cellulose (CMC), and agar, and the nicotine sheet includes about 25 to about 90 parts by weight of the cellulose-based material with respect to a total of 100 parts by weight.

2. The nicotine sheet of claim 1, wherein the nicotine material includes nicotine salt formed by an organic acid.

3. The nicotine sheet of claim 2, wherein the organic acid includes at least one acid selected from the group consisting of benzoic acid, pyruvic acid, lactic acid, acetic acid, and citric acid.

4. The nicotine sheet of claim 1, wherein a content of the nicotine component is 2 parts by weight or more with respect to a total of 100 parts by weight of the nicotine sheet.

5. The nicotine sheet of claim 1, further comprising an aerosol-forming agent.

6. The nicotine sheet of claim 5, wherein a content of the aerosol-forming agent is in a range of 5 to 20 parts by weight with respect to a total of 100 parts by weight of the nicotine sheet.

7. An aerosol-generating article comprising:

a filter part;

an aerosol-forming substrate part; and a wrapper configured to wrap around at least a portion of the filter part and the aerosol-forming substrate part, wherein a nicotine sheet is applied to the aerosol-forming substrate part or the wrapper, and the nicotine sheet includes a cellulose-based material and a nicotine material, wherein the cellulose-based material includes at least one material selected from hydroxypropyl methylcellulose (HPMC), methyl cellulose (MC), ethyl cellulose (EC), carboxymethyl cellulose (CMC), and agar, and the nicotine sheet includes about 25 to about 90 parts by weight of the cellulose-based material with respect to a total of 100 parts by weight.

8. The aerosol-generating article of claim 7, wherein the nicotine sheet is pleated or folded.

9. The aerosol-generating article of claim 7, wherein a plurality of holes are formed in the nicotine sheet.

10. The aerosol-generating article of claim 7, wherein the nicotine sheet is included in a cut form in the aerosol-forming substrate part.

11. The aerosol-generating article of claim 7, wherein the nicotine sheet is included in a rolled from form in the aerosol-forming substrate part.

12. The aerosol-generating article of claim 7, wherein the nicotine sheet is disposed on an inner side of the wrapper.

13. The nicotine sheet of claim 1, wherein the cellulose-based material covers the nicotine material.

14. The aerosol-generating article of claim 7, wherein the cellulose-based material covers the nicotine material.

* * * * *